United States Patent [19]

Wood

[11] 4,158,844

[45] Jun. 19, 1979

[54] CONCEALABLE ANTENNA MOUNT FOR CB ANTENNAS

[76] Inventor: Harvey L. Wood, 5411 Manor Creek La., Houston, Tex. 77018

[21] Appl. No.: 668,321

[22] Filed: Mar. 18, 1976

[51] Int. Cl.[2] ..... H01Q 1/32

[52] U.S. Cl. ..... 343/715; 343/882; 248/539

[58] Field of Search ..... 343/711, 712, 713, 714, 343/715, 709, 710, 880–883; 52/110; 248/514, 515, 539

[56] References Cited

U.S. PATENT DOCUMENTS

| | | | |
|---|---|---|---|
| 2,702,346 | 2/1955 | Evans et al. | 343/705 |
| 3,259,901 | 7/1966 | Bykerk | 343/715 |
| 3,369,247 | 2/1968 | Bacow | 343/715 |
| 3,860,932 | 1/1975 | Hochbrueckner | 343/713 |
| 3,873,985 | 3/1975 | Altmayer | 343/714 |

FOREIGN PATENT DOCUMENTS

| | | | |
|---|---|---|---|
| 1200425 | 12/1959 | France | 343/713 |

*Primary Examiner*—Eli Lieberman

*Attorney, Agent, or Firm*—Ned L. Conley; Murray Robinson; David M. Ostfeld

[57] ABSTRACT

An antenna mount is disclosed. It includes a hinge connected to a first metal bracket which is adapted to be fixedly attached adjacent to the edge of a trunk in the interior space of an automotive trunk. There is a movable mounting bracket on the hinge which supports an L-shaped arm having a lengthwise slot. The antenna coaxial cable is positioned in the slot, and the cable and arm protrude through the trunk opening even when the trunk lid is closed. The L-shaped arm supports the antenna base on the exterior when erected. The L-shaped arm can be moved by pivoting around the hinge to a recessed location in the trunk thereby retracting the antenna and enabling it to be closed out of sight to avoid theft of the antenna.

26 Claims, 4 Drawing Figures

FIG. 1
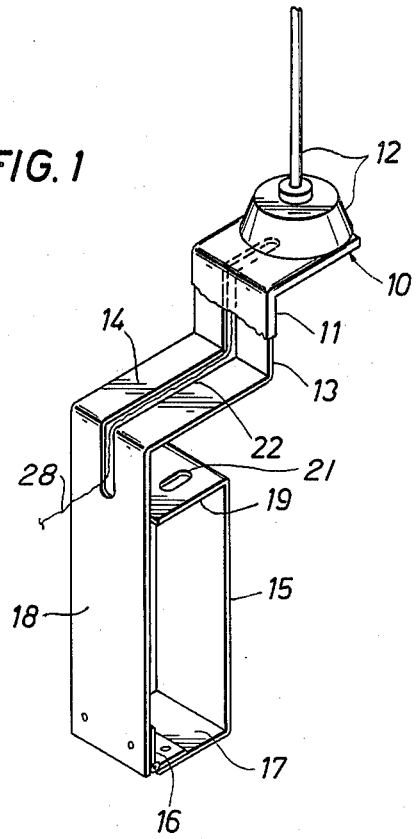
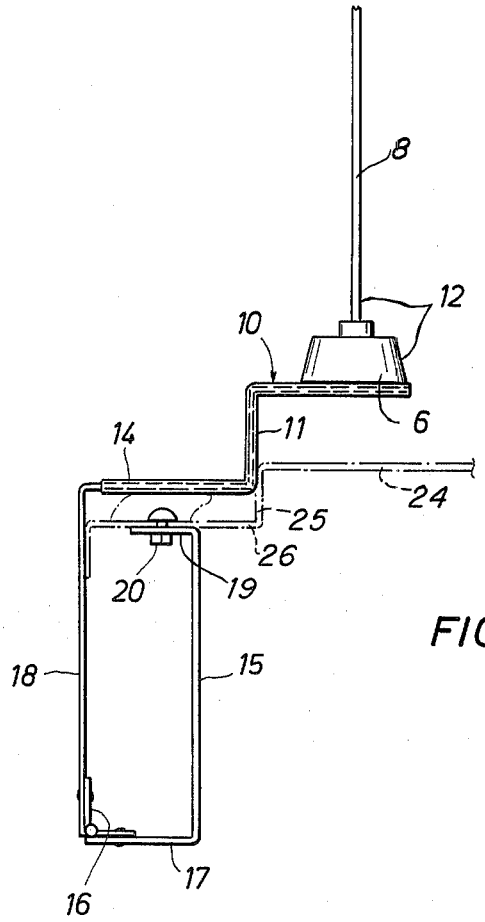
FIG. 2
FIG. 4
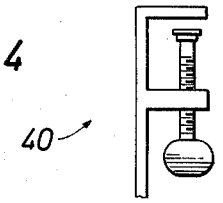
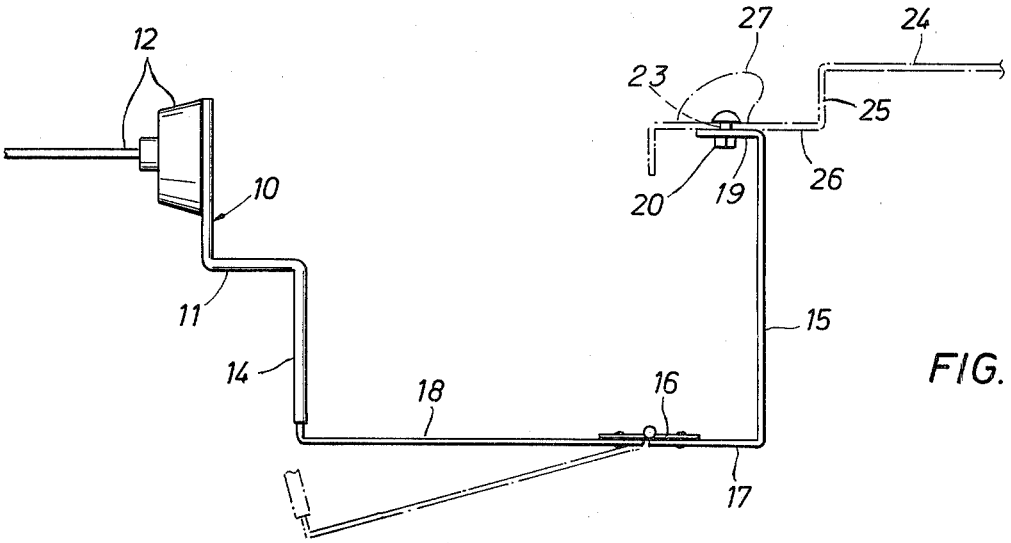
FIG. 3

CONCEALABLE ANTENNA MOUNT FOR CB ANTENNAS

BACKGROUND OF THE INVENTION

CB radios require a small whip quarter length antenna to be mounted on a vehicle for adequate transmission and reception. CB antennas are often stolen or broken. The problem is epidemic with a large percentage of the CB antennas being broken or stolen.

The apparatus of the present invention is an antenna mount which protects the antenna against theft or vandalism. It is an antenna mount which is anchored in the trunk space of an automobile. The mount permits the owner to retract the antenna and mount completely out of sight within the trunk space where it is protected by closure and latching of the truck lid. When this occurs, the antenna is completely out of sight and of course, the CB equipment in the car itself is substantially safer because the antenna is no longer visible, thereby advertising to thieves and vandals that the equipment is in the car. When the user wants to operate his CB equipment, it is only necessary that he open the trunk, move the antenna mount of the present invention from its retracted position to an upright position and thereafter close the trunk lid. The trunk is equipped with an underhanging metal lip supporting a gasket or grommet typically made of resilient material which prevents leakage of rain water into the trunk space. The antenna mount of the present disclosure thus is retractable to a position which is out of sight and yet it does not interfere with the operation of the trunk lid, the gasket preventing leakage into the trunk, or the other equipment of the automobile.

It is with foregoing problems in view that the present apparatus has been devised. This apparatus is a new antenna mount apparatus which is summarized in the following description.

SUMMARY OF THE DISCLOSURE

This disclosure is directed to a CB radio antenna mount apparatus. The apparatus of this disclosure incorporates fixed and movable members which are joined by a hinge. The members are preferably made of strap metal. The fixed member is attached to the automobile on the interior of the trunk. It is attached by clamps, or by bolts which bolt through holes drilled in a portion of the automobile body which is not exposed. The movable member has an L-shaped arm which supports the base of an antenna mount. The two members are connected by a hinge. The hinge enables pivotal movement to a withdrawn position and an erected position where the L-shaped arm extends over the edge of the body at the trunk and in particular the grommet around the trunk opening. The L-shaped movable member incorporates a lengthwise slot which permits recessing the antenna coaxial cable where it is protected against pinching and which enables it to feed the signal to the antenna guided or routed by the hinged movable member.

DESCRIPTION OF THE DRAWINGS

FIG. 1 is a perspective view of the antenna mount of the present apparatus shown in an erect position;

FIG. 2 is a plan view showing the antenna mount of the present invention in its erected position and showing the mounted position adjacent to the edge of a trunk opening;

FIG. 3 is a view similar to FIG. 2 showing the antenna folded to a retracted position where it is enclosed in the closed trunk; and FIG. 4 is a partial side view of an alternative construction of the apparatus.

DESCRIPTION OF THE PREFERRED EMBODIMENT

In the drawings, the antenna mount of the present disclosure is identified by the numeral 10. The antenna mount as a whole incorporates three major members, one being a fixed member, the second being a movable member, and the third comprising a hinge joining the two members together. On rotation about the hinge, the movable member is moved between an erect position and a retracted position, thereby positioning the antenna for use or placing it safely in the confines of the locked trunk.

MOVABLE MEMBER

Considering the apparatus in detail, the movable portion incorporates an L-shaped arm 13 which supports an antenna 12. The L-shaped arm 13 is appended to a straight portion 14 at right angles to the arm 13. The apparatus is preferably formed of metal strapping typically having a width of about two inches and having a thickness up to about 3/32 inch or so. Thinner metal straps can be used. It is preferable that metal straps be used to define a ground connection which is electrically connected to the frame of the automobile. The L-shaped portion 13 and the appended straight portion 14 are centrally divided by a lengthwise slot 22. The slot 22 has a width which equals or slightly exceeds the diameter of the coaxial cable 28 which connects the antenna 12 to the CB radio itself. It will be understood that the antenna wire 28 is normally a central conductor wire provided with shielding around it and two insulative layers. This defines a coaxial cable of specified diameter which is preferably not larger than the thickness of the strapping material used in the fabrication of the antenna mount 10. The actual diameter is not limited by the metal strap thickness.

The antenna mount is constructed and arranged to locate the antenna 12 on the exterior of the vehicle when it is in use. The apparatus 10 enables the user to retract or reposition the antenna into the trunk, thereby placing it beyond the reach of vandals or thieves. To this end, some movement is contemplated and suitable extra cable length is incorporated in the antenna system to enable the antenna 12 to move from position to position without binding or pulling on the cable connections.

The L-shaped portion 13 supports the base 6 on the antenna. The antenna itself incorporates a whip portion 8 standing upright above a base. The base typically incorporates an insulator which is bolted or otherwise joined to the L-shaped portion 13. The base includes an electrical connection for the lead-in wire 28 positioned in the slot 22. It will be observed that the strap material which has the slot 22 cut therein is folded. The folds enable the coaxial cable to be located in the slot.

As described to this juncture, the apparatus includes the L-shaped arm 13 which is appended to an integrally manufactured arm 14. As disclosed in FIG. 2 of the drawings, a single piece of metal is preferably used and it is processed through the use of a sheet metal brake to shape it. Thus, it terminates in the downwardly directed arm 18 which is affixed to a hinge 16. A single piece of stock is thus used to form the four straight line segments which are preferably bent at right angles to one another to thereby define a movable member as claimed hereafter. This movable member is adapted to be pivoted between a retracted position in the trunk space of a vehicle and alternately positioned where the outer end of it is cantilevered in space and yet is just positioned adjacent to the lip of a truck lid to extend through the slot between the trunk lid and the body of the automobile to locate the antenna base on the exterior. The antenna base and antenna appended to it are thus in an erect position to be used for CB transmission. By contrast, the movable member and the antenna are all positioned inside the trunk when retracted to a position out of harms reach.

The movable member thus is formed of metal strapping of a sufficient gage to maintain its structural integrity and to support the weight of the antenna. It is preferably folded so that it abuts the gasket in the rain gutter adjacent to the trunk lid. Most automobiles are constructed in a manner where the trunk lid overlies a rain gutter portion of the automobile body. The rain gutter is equipped with a resilient gasket which gasket is compacted or compressed when the trunk lid is closed. When the trunk lid is closed, the trunk lid itself moves to an immediate overlying position adjacent to the rain gutter. This position enables the trunk lid to close and excludes rain water at the gasket in the rain gutter.

The movable member is dimensioned such that it has a length approximating the rain gutter at the arm portion 14 and is bent at approximately 90° to extend through the gap at the edge of the trunk lid adjacent to the exterior body portion of the automobile. This then locates the antenna base perhaps ½ inch to 1½ inch above the automobile body. This avoids contact of the antenna support structure against the exterior of the automobile and hence avoids scratching or otherwise damaging the exterior of the automobile. Customary manufacturing tolerances in the construction of automobiles allow a gap between the trunk lid and the surrounding automobile body sufficient to receive the thin metal member therebetween. This does not bend or otherwise warp the trunk lid. An alternative embodiment of the present disclosure utilizes a thin plastic film 11 placed on the movable member. Preferably, a plastic sleeve encompasses the movable member. It is not necessary that the sleeve extend the full length thereof; rather, it can be limited to that portion which is exposed and which otherwise comes into contact with the nether side of the trunk lid and the edge of the rain gutter. Needless to say, the sleeve can be omitted. If it is used, it preferably encloses the slot 22 formed in the movable member and the coaxial cable 28 positioned in that slot.

FIXED MEMBER

The present apparatus as claimed hereinafter additionally includes a "fixed member" and a hinge means. The fixed member is shown in the drawings to incorporate a tab 17 which is joined to the hinge 16 and which then bends into an elongate arm 15 terminating in an upturned tab 19. FIG. 2 shows the antenna in the erected position and there it will be observed that the parts 17 and 19 are bent approximately parallel to one another. The hinge is rotated until the parts 15 and 18 are approximately parallel to one another. This locates the tab 19 just under the rain gutter. The tab 19 has lengthwise slots 21, only one of which is shown, which are suitable for receiving nuts and bolts 20, only one of which is shown, extending therethrough to anchor the fixed member. The fixed member is preferably anchored by the use of nuts and bolts 20 which thread through the openings therein, some movement being permitted to enable precise positioning of the fixed member. Moreover, the tab 19 is held in position by the bolts 20 which thread through holes 23, only one of which is shown, drilled in the rain gutter. If the owner is apprehensive about drilling holes 23 in the rain gutter (at a location which is out of sight and covered over by the trunk lid when the trunk lid is closed), resort may be had to the clamping means 40 shown in FIG. 4. The clamping means 40 does not require the drilling of any holes. Rather, it reaches over the rain gutter on the top side, and on the bottom side, it has an adjustable screw clamp which secures the fixed member by clamping against the lower side of the rain gutter. The rain gutter thus serves as a protruding ledge, and the clamp means 40 shown in FIG. 4 secures the fixed member thereto. For a sure connection, preferably two or three thumb screws are incorporated. To this end, the fixed member is preferably formed of a strip of material sufficiently wide to enable two or three holes to be drilled in it for receiving the thumb screws. The thumb screws themselves are threaded and are provided with a head which is easily engaged by hand or finger tightening and which can be further gripped with a pair of pliers to tighten the thumb screws.

INSTALLATION

Returning now to FIG. 2 of the drawings, it will be observed that the fixed member secures the hinge 16 at a location in the trunk space which enables movement of the antenna between two positions. FIG. 2 shows the antenna in the erect position where the movable member extends through the slot between the trunk and the body of the automobile to position the antenna for use. The retracted position is achieved by opening the trunk lid and rotating the movable member about the hinge 16. When this occurs, the movable member rotates to about 90° (the extent of rotation is not critical) and the antenna is then located fully within the trunk. The quarter length antenna normally has a height which enables it to be received fully within the trunk of an average sized vehicle. When it is in the retracted position, the trunk lid is thereafter closed. When this occurs, the antenna is completely out of sight.

As a practical matter, the antenna coaxial cable has sufficient length to permit the movement of the antenna illustrated in FIG. 3. In addition, the antenna 12 itself preferably uses the antenna mount 10 of the present invention as an electrical ground and to this end, a ground wire connected between the fixed and the movable members and spanning the hinge 16 may be included. This will be helpful if the hinge is not adequately conductive. The ground wire can otherwise extend from the movable member to any conveniently exposed grounding point in the trunk of the vehicle and if provided with adequate length, will permit the movement contemplated for the antenna system.

The apparatus is preferably installed with the axis of rotation of the hinge approximately parallel to the drive shaft of the vehicle or, stated differently, positioned where the antenna is erected at the right or left hand edge of the trunk lid. This locates the antenna where it is substantially vertical when erected although it is not required that it be precisely vertical. Deviation from precise vertical location does not reduce the quality of the transmitted signal. The vertical antenna is held firmly by clamping action between the trunk and rain gutter. The trunk lid normally closes flush with the automobile body 24 which is raised by a height equal to the depression 25 adjacent the gutter. The grommet or gasket 27 is made of yeildable material which can be pushed aside or punctured to receive the bolts 20 of FIG. 2. The grommet 27 is glued on the gutter 26.

Alterations and variations of the present device can be incorporated. For instance, the drawings show the fixed and movable members having equal width adjacent to the hinge 16. If desired, they can be offset, as for example where the fixed member is to one side or the other of the movable member. This requires a longer and hence more complex hinge.

The foregoing is directed to the preferred embodiment but the scope thereof is determined by the claims which follow.

I claim:

1. An automotive antenna mounting apparatus for use in attaching an antenna to an automobile which has a trunk space closed over by a trunk lid forming a slot between the trunk lid and the body of the automobile, the apparatus comprising:

a fixed member including means for fixedly attaching said fixed member to such automobile in such trunk space thereof;

a movable member;

pivot means connected between said fixed member and said movable member to enable movement of said movable member between two positions; and said movable member including first means for receiving such antenna thereon and second means for extending said first means through such slot in one of said two positions, whereby on operation of said pivot means, such antenna may be moved to an exposed position on such automobile permitting use of such antenna and may also be moved to a retracted position in such trunk space of such automobile.

2. The apparatus of claim 1 wherein such antenna includes a coaxial cable dependent therefrom and said movable member has, at least along a portion thereof, a slot for receiving such antenna coaxial cable therein.

3. The apparatus of claim 1 wherein said pivot means is a hinge.

4. The apparatus of claim 1 wherein said fixed member is formed of strap material of a rigid construction which is constructed and arranged into a hinge-connective portion, and includes additional portion adapted to be fixedly attached to such automobile.

5. The apparatus of claim 4 wherein said hinge-connective portion is joined to a hinge comprising said pivot means.

6. The apparatus of claim 5 including a second hinge-connective portion which comprises a portion of said movable means.

7. The apparatus of claim 2 wherein such antenna includes a trunk mount base and a coaxial cable depending therefrom and said first means includes a platform and said slot extends into said platform a sufficient distance to permit the insertion of such antenna coaxial cable without detachment from such antenna.

8. The apparatus of claim 1 wherein such automobile body includes a rain gutter with a gasket thereon below such slot and said movable member includes means for forming a seal with such gasket.

9. The apparatus of claim 1 wherein said attachment means includes a "C" clamp.

10. The apparatus of claim 1 wherein such automobile body includes a rain gutter with a hole therein and said attachment means includes a tab having a slot therein, a nut and a bolt for attaching said fixed member to such rain gutter through such hole.

11. An automotive antenna mounting apparatus for use with an automobile which has a trunk space closed over by a trunk lid and an antenna, the apparatus comprising:

a fixed member incorporating means for fixedly attaching said fixed member to the automobile in the trunk space thereof;

a movable member;

pivot means connected between said fixed member and said movable member to enable movement of said movable member between two positions;

said movable member receiving the antenna base on a portion thereof which portion, on operation of said pivot means, moves to an exposed position permitting use of the antenna and which also moves to a retracted position in the trunk space of the automobile; and wherein said movable member includes at least three connected arm portions bent at angles to enable said arm portions thereof to extend through the slot between the trunk lid and the automobile body.

12. An automotive antenna mounting apparatus for use with an automobile which has a trunk space closed over by a trunk lid and an antenna with a base, the apparatus comprising:

a fixed member incorporating means for fixedly attaching said fixed member to the automobile in the trunk space thereof;

a movable member;

pivot means connected between said fixed member and said movable member to enable movement of said movable member between two positions;

said movable member receiving the antenna base on a portion thereof which portion, on operation of said pivot means, moves to an exposed position permitting use of the antenna and which also moves to a retracted position in the trunk space of the automobile; and wherein said movable member includes an elongate strap-like member having two ends, one of which has means for connecting to said pivot means and the other of which is an antenna base-supportive means for supporting the antenna base, and said strap-like member is bent into a shape passing through the closed trunk lid.

13. An antenna mount for mounting an antenna adjacent the juncture between the lid of the trunk of an automobile and the body of the automobile, comprising:

a first portion having means thereon adapted for rigid attachment inside the trunk, and a second portion pivotally attached to the first portion, including a segment adapted to traverse said juncture and a segment adapted to mount said antenna, the pivotal attachment being such that when the first portion is attached inside the trunk, the second portion can be pivoted to move the antenna between a normal outside position and a concealed position within the trunk.

14. An antenna mount as defined by claim 13 wherein such antenna has a coaxial cable depending therefrom and including a slot in said segment in a direction and having sufficient length to traverse said juncture and having a width sufficient to receive a coaxial cable for said antenna.

15. An antenna mount as defined by claim 13 wherein the first and second portions are of such a configuration that the antenna may be moved from outside position to concealed position by pivoting through an arc of no more than about 90 degrees.

16. An antenna mount as defined by claim 13 and including a conduit adapted to traverse said juncture to protect the antenna's coaxial cable from being pinched.

17. An antenna mount as defined by claim 16 and including means for securing the coaxial cable within the conduit.

18. An antenna mount as defined by claim 13 wherein the first portion comprises a substantially U-shaped member having an upper, relatively short, leg and a lower, relatively long, leg, at least one elongated opening in the upper leg for receiving an attaching bolt, and a hinge attached to the lower leg, and the second portion comprises a segment depending from the juncture traversing segment, said hinge also being attached to the depending segment to provide said pivotal attachment.

19. An antenna mount as defined by claim 13 made of an electrically conductive material, and including a ground connection between the first and second portions.

20. An antenna mount as defined by claim 1 wherein the pivotal attachment allows movement of substantially 90 degrees.

21. An automobile antenna mounting apparatus for use in supporting, at the exterior of an automobile, an antenna, the antenna having a base, the automobile having a trunk space formed by the body of the automobile and a trunk lid and the body having a rain gutter with a gasket thereon at the bottom of the space between the closed trunk lid and the gutter portion of the body of the automobile for forming a seal at the juncture between the lid and the body, the apparatus comprising:

a first member having means thereon adapted for rigid attachment within the trunk space, and a sinuous second member attached to the first member, said second member including an antenna mounting segment having means thereon for mounting the antenna base and a juncture traversing segment extending between the first member and the antenna mounting segment, said juncture traversing segment including three sections at substantially right angles to each other, the first section including means thereon for connecting to the first member, the second section being adapted to traverse said gasket and rain gutter, and the third section being connected at substantially a right angle to said antenna mounting segment.

22. Apparatus as defined in claim 21 wherein the first member is attached to the second member by means of a pivot which allows relative movement of at least about 90°.

23. Apparatus as defined by claim 21 and including a slot in said second member extending from the antenna mounting segment to the first section of the juncture traversing segment, said slot having a width sufficient to receive the antenna coaxial cable.

24. Apparatus as defined by claim 21 made of electrically conductive metal.

25. Apparatus as defined by claim 21 wherein said juncture traversing segment has a thickness no greater than about 3/32 inch, and has sufficient strength to support an antenna above the automobile body.

26. An automotive antenna mounting apparatus for use in attaching an antenna to an automobile which has a trunk space closed over by a trunk lid forming a slot between the trunk lid and the body of the automobile, comprising:

a fixed member including means for fixedly attaching said fixed member to said automobile in said trunk space thereof, a movable member, said movable member having a first portion for supporting said antenna in an exposed position and a second bight portion connected to said first portion and extendable through said slot, and means movably joining the bight portion to said fixed member whereby said antenna can be raised and held in an operative exposed position with said bight portion clamped in slot by the trunk lid or can be moved, when the trunk lid is raised, to a retracted position within the trunk space.

* * * * *

UNITED STATES PATENT AND TRADEMARK OFFICE

CERTIFICATE OF CORRECTION

PATENT NO. : 4,158,844

DATED : Harvey L. Wood

INVENTOR(S) : June 19, 1979

It is certified that error appears in the above—identified patent and that said Letters Patent is hereby corrected as shown below:

Column 3, line 15, "harms" should read -- harm's --.
line 17, "gage" should read -- gauge --.
line 34, after "1-1/2" delete "inch" and insert -- inches --.

Column 5, line 6, "yeiladable" should read -- yieldable --.

Column 7, line 31, after "claim" delete "1" and insert -- 13 --.

Signed and Sealed this

*Eleventh* Day of *December 1979*

[SEAL]

*Attest:*

SIDNEY A. DIAMOND

*Attesting Officer*

*Commissioner of Patents and Trademarks*